US006289644B1

(12) United States Patent
Gerhaher

(10) Patent No.: US 6,289,644 B1
(45) Date of Patent: Sep. 18, 2001

(54) EXTERNALLY SUSPENDED FACADE SYSTEM

(75) Inventor: Max Gerhaher, Dr.-Aicher-Str. 3, 94405 Landau (DE)

(73) Assignees: Max Gerhaher; Franz Gerhaher, both of Straubing (DE)

( * ) Notice: Subject to any disclaimer, the term of this patent is extended or adjusted under 35 U.S.C. 154(b) by 0 days.

(21) Appl. No.: 09/078,586

(22) Filed: May 13, 1998

(30) Foreign Application Priority Data

May 13, 1997 (DE) ..... 197 20 016

(51) Int. Cl.[7] ..... E04H 1/00

(52) U.S. Cl. ..... 52/235; 52/506.1; 52/506.9; 52/508; 52/378; 52/325

(58) Field of Search ..... 52/506.09, 506.1, 52/508, 378, 379, 235

(56) References Cited

U.S. PATENT DOCUMENTS 3,545,154 12/1970 Bobzin et al. .
5,177,929 * 1/1993 Reynolds ..... 52/506.1
5,390,457 2/1995 Sjölander .
5,860,257 * 1/1999 Gerhaher et al. ..... 52/235

FOREIGN PATENT DOCUMENTS 3401271 7/1985 (DE) .
3627584 2/1988 (DE) .
3934686 6/1990 (DE) .

* cited by examiner

*Primary Examiner*—Carl D. Friedman
*Assistant Examiner*—Christy M. Syres
(74) *Attorney, Agent, or Firm*—Ostrolenk, Faber, Gerb & Soffen, LLP

(57) ABSTRACT

An externally suspended facade system comprises a subsystem, either horizontal or vertical sections or both, facade boards, which can be secured by means of board holders on the horizontal or vertical sections, and joint sections which are arranged in behind the vertical joints or both, between the facade boards. In order to reduce the material input, to shorten the necessary assembly time and to increase the proofing against incident rain, the board holder is arranged centrally to the vertical joints and designed to engage by means of one or more tongues into the vertical joints between one or more pairs of boards.

9 Claims, 3 Drawing Sheets

EXTERNALLY SUSPENDED FACADE SYSTEM

BACKGROUND OF THE INVENTION

The invention relates to an externally suspended facade system, preferably mounted on an aluminum subsystem, according to the preamble of claim 1.

DE-PS 34 01 271 and manufacturers' brochures have disclosed a facade system whose boards are secured by means of narrow board holders to horizontal or vertical supporting sections. In this system, an H-shaped piece of the board holder engages around the head rabbet of the respectively lower board and the foot rabbet of the respectively upper board. The board holders are in general arranged in pairs at the head and foot rabbets, respectively, of the facade boards, which are preferably embodied in transverse format and are offset slightly inwards from the corners of the facade boards so that the facade boards are secured at 4 points. Since the H-shaped pieces of the board holders are active upwards and downwards, there is a requirement throughout the surface of two board holders per facade board. The disadvantage of this system lies in the high requirement of two board holders for each facade board, as a result of which both the materials costs and the labor costs for the completely installed facade system are increased. In addition, the high head rabbet in particular is exposed to a substantial risk of breaking if the facade board is subjected to a heavy impact from the front, as in this event, as a result of slight tilting of the facade board, the head rabbet rests with its top rearward edge on the board holder, so that the supporting force acts on the head rabbet with a long lever arm.

Also known from DE-PS 36 27 584 and from manufacturers' brochures is a joint section for the vertical joints of facade systems, which is intended to prevent the relative movement of the facade boards in the horizontal direction in the plane of the facade and the clattering of the facade boards in a wind. The joint section consists of a central knuckle of the width of the vertical joint provided between the facade boards and two resilient double legs arranged on both sides of the central knuckle. The joint section is mounted in long bars and so ensures clean flush fitting of the vertical joints. The disadvantage of this system lies in the fact that the joint section described, because of the necessary resilient action, must be produced from very thin material and therefore bends easily out of true during installation or requires a long assembly time if the necessary care is taken. In addition, because of the necessary 7-fold beveling, it is costly to produce. For both reasons, the production costs of the completely installed facade system are increased. A further disadvantage of this joint section lies in the fact that it provides only inadequate sealing of the vertical joint against incident rain, since the legs of the central knuckle are continued in a straight line to the support point on the supporting section and therefore narrow gaps may be left as a result of production tolerances, through which water may be driven which reaches the supporting profile and, via this, the heat insulation, and soaks the latter.

SUMMARY OF THE INVENTION

The object of the invention is therefore to describe a facade system in which the material input is reduced and the necessary assembly time is shortened and the proofing against incident rain is increased.

This object is achieved, according to the invention, by the characterizing clause of claim 1. The advantage of this embodiment lies in the fact that, in each case, two upper and two lower facade boards are secured by a single board holder in their corner regions on the supporting sections of the subsystem. In each cruciform joint of the facade, therefore, one board holder is arranged; therefore the demand in the surface of the facade is only one board holder per facade board, whereas in facade systems according to the state of the art two board holders are necessary for each facade board. As a result, material costs are saved and assembly times are shortened. A further advantage of this embodiment lies in the fact that the facade boards are held at an exact joint distance apart by tongues or tabs which are attached or notched onto the board holders in precise alignment, one above the other, and that as a result the vertical joints of the pair of boards arranged respectively uppermost are precisely aligned with the vertical joints of the pair of boards arranged respectively lowermost. In this arrangement, the width of the tongues or tabs corresponds, with the necessary relatively slight play, to the clear width of the vertical joints between the facade boards. Instead of the tongues or tabs it is also possible to notch-fit double tongues or tabs whose overall dimension from outer edge to outer edge corresponds to the width of a single tongue. In the assembly of the facade system, in each case the lower tongue or the lower pair of tongues of the board holder is introduced from above into the vertical joint between the lower pair of boards, as a result of which the board holder is precisely centered on the center of the joint before its final fixing on the supporting section. As the upper tongue of the board holder is also arranged centrally over the lower tongue, the assembly of the upper pair of boards automatically results in an alignment of the vertical joint of the upper pair of boards with that of the lower.

In another particularly advantageous embodiment as claimed in claims 3 and 4, a joint section with a knuckle is arranged between the vertical joints of the upper and lower pairs of boards, which section engages around the vertical rear edges of the facade boards arranged on both sides and is supported on the board holder or on the support section by means of simple resilient legs on both sides. The tongues attached to the board holder, in this arrangement, do not engage directly into the vertical joints between the respective pairs of boards but only into the knuckles, which are open at the rear, of the joint sections arranged in the vertical joints. The advantages of this embodiment lie in the fact that the joint section, which is preferably made from very thin sheet metal or plastic, although it does keep the facade boards at a precise distance apart, is nevertheless so extensively deformable both elastically and plastically that reactive forces and therefore damage to or breakage of facade boards cannot occur either during assembly or in the event of subsequent relative movements of the facade resulting from wind stress or settling of the building. Furthermore, the joint section is resiliently supported by the ends of its two outward-splayed legs on the board holder in its lower region and, resiliently, on the supporting section in its upper region and thus presses the facade boards on both sides, around whose vertical rear edges it engages, elastically toward the front of the facade until the play between the head and foot rabbets of the facade boards on the one hand and the board holder on the other hand is balanced. The advantage of this embodiment lies, first, in the fact that the joint section with its inward-projecting edges engages tightly around the rear vertical edges of the facade boards and thus forms a particularly effective seal against the penetration of incident rain. Furthermore, this joint section is substantially cheaper than the joint section according to the state of the art, since it is provided only with one knuckle and 2 bevels instead of one knuckle and 6 bevels. A further advantage resides in the fact that it can be mounted simultaneously with the facade boards in short sections and the laborious handling of the long joint sections according to the state of the art is no longer necessary, as a result of which assembly time is spared.

Another advantageous embodiment of the facade system according to the invention, as claimed in claim 5, lies in the fact that the U-shaped parts of the board holder which engage around the head rabbet of the two lower facade boards and/or the foot rabbet of the two upper facade boards are notched in the middle section thereof. The advantage resulting from this lies in the fact that the head and/or foot rabbets of the facade boards are not flexurally stressed at the extreme end, since that is where the danger of breakage is greatest. As a result of the notching of the board holder, the respective point of attack of the load on the board holders is shifted from the end of the rabbet toward the middle of the rabbet, where what is known as the co-supporting width of the rabbet is much greater. Tests have shown that, in the event of impact stress on the facade boards from the direction of the front of the facade, the breaking strength of the rabbets is increased by up to two and a half times by the described shifting of the point of attack of the stress.

In a further embodiment of the facade system according to the invention as claimed in claim 6, the rear legs of the board holder, engaging around the head rabbet or foot rabbet, are provided with reinforcements at their ends which are directed toward the rear of the facade board. The advantage which derives from this resides in the fact that, in the event of an impact stress acting on the front of the facade board, the point of attack of the stress is shifted from the head of the respective rabbet to its foot or even to the actual board body itself. The result is that the impact stress which can be absorbed without damage by the facade board is increased to a multiple of the impact stress which can be absorbed by a facade board secured with a conventional holder. If an identical facade board is secured with board holders according to the state of the art, the facade board, when exposed to an impact stress from the front in the region of the play between board holder and head rabbet, executes a slight tilting movement backward and thus bears with the upper rear edge of the head rabbet against the board holder. The bending stress acting on the head rabbet foot thus has its maximum possible magnitude because of the long lever arm. By contrast, the lever arm of the rear leg of the board holder is very short at this point, as a result of which elastic deformability is very low. In the board holder according to the invention, the shifting of the attack point of the stress to the lower end of the leg of the board holder not only substantially shortens the length of the active lever arm of the head rabbet, or eliminates it completely, but at the same time the active lever arm of the rear leg of the board holder is substantially lengthened, as a result of which it is able to transmit the impact loads applied to the facade board much more elastically to the board holder and so to the subsystem than is possible with the board holder according to the state of the art.

In a further alternative embodiment of the facade system, the back legs of the H-shaped piece of the board holder are eliminated. The facade boards are then merely pressed forward by the resilient joint sections and, in the event of an impact load from the front, rest on the front of the board holders or on the lower front edge of the supporting sections.

The invention further relates to a board holder for an externally suspended facade system and a joint section for an externally suspended facade system. In order to achieve the object stated above, the board holder has the features of claim 7. Advantageous further embodiments are described in claims 8, the joint section, in order to achieve the object stated above.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

Other features and advantages of the present invention will become apparent from the following description of the invention which refers to the accompanying drawings.

DETAILED DESCRIPTION OF THE INVENTION

Figure 1:
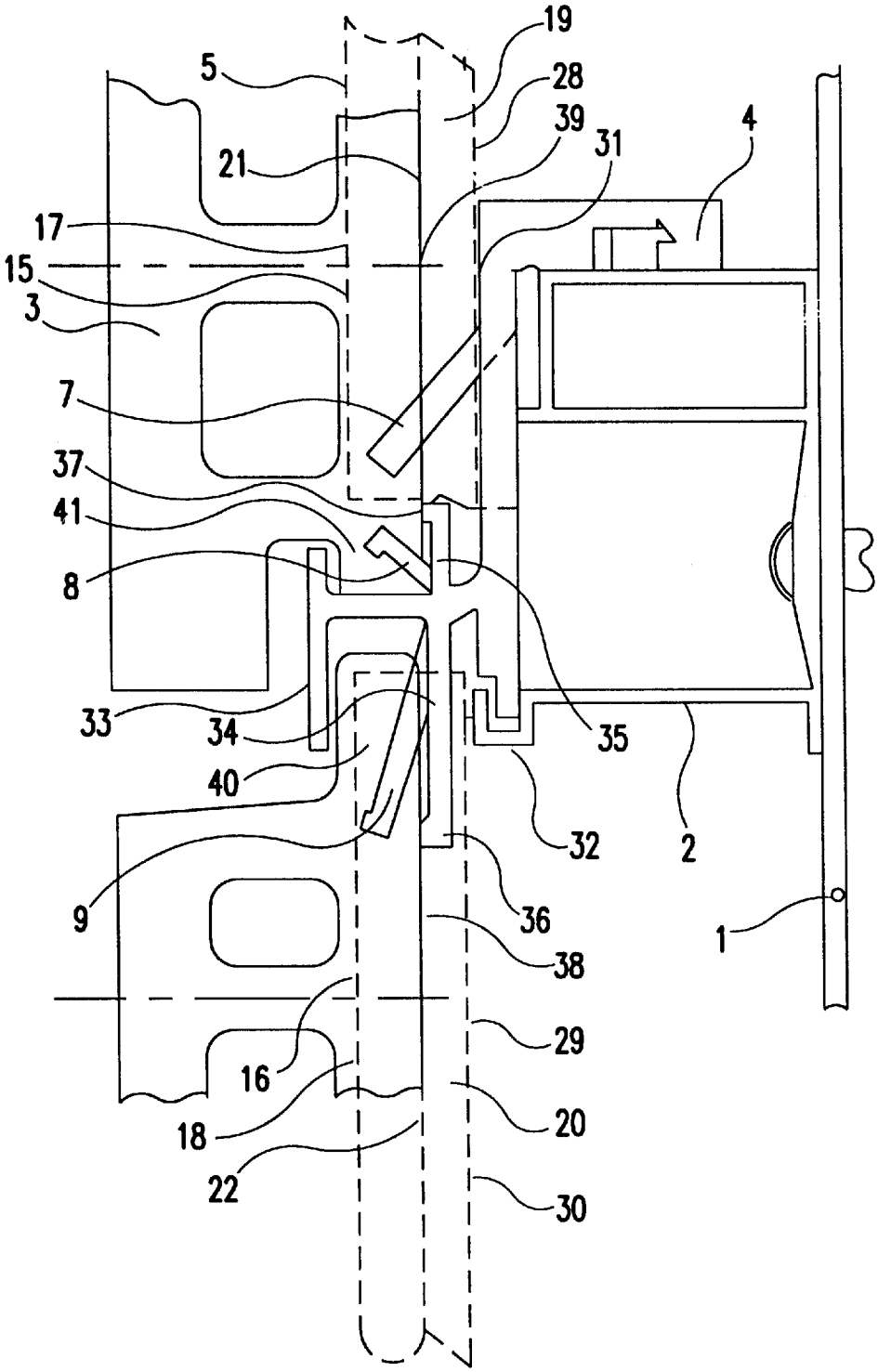
FIG. 1 shows a vertical section through the facade system according to the invention.

FIG. 1 shows the subsystem 1, and the horizontal section 2 on which the facade boards 3 are secured by means of the board holder 4. The joint sections 5, 17, 18 (drawn in broken lines for reasons of clarity) consist of a knuckle 15, 16 and resilient legs 19, 20 whose ends 28, 30 bear on the front surface 31 of the board holder 4 and/or on the front edge 32 of the horizontal section 2. The tongue 7 engages into the knuckle 15 of the upper joint section 17 and the tongue 9 into the knuckle 16 of the lower joint section 18. The tongue 8 engages into the vertical joint 6 (shown in FIG. 2) between the upper facade boards 3 and can also undertake the function of centering the tongue 7 in its position. The rear legs 34, 35 of the board holder 4 are provided at their ends with reinforcements 36, 37, so that the facade boards, when loaded from the front, bear with their rear sides 38, 39 on the reinforcements 36, 37, so that the head rabbet 40 and the foot rabbet 41 are not flexurally stressed.

Figure 2:
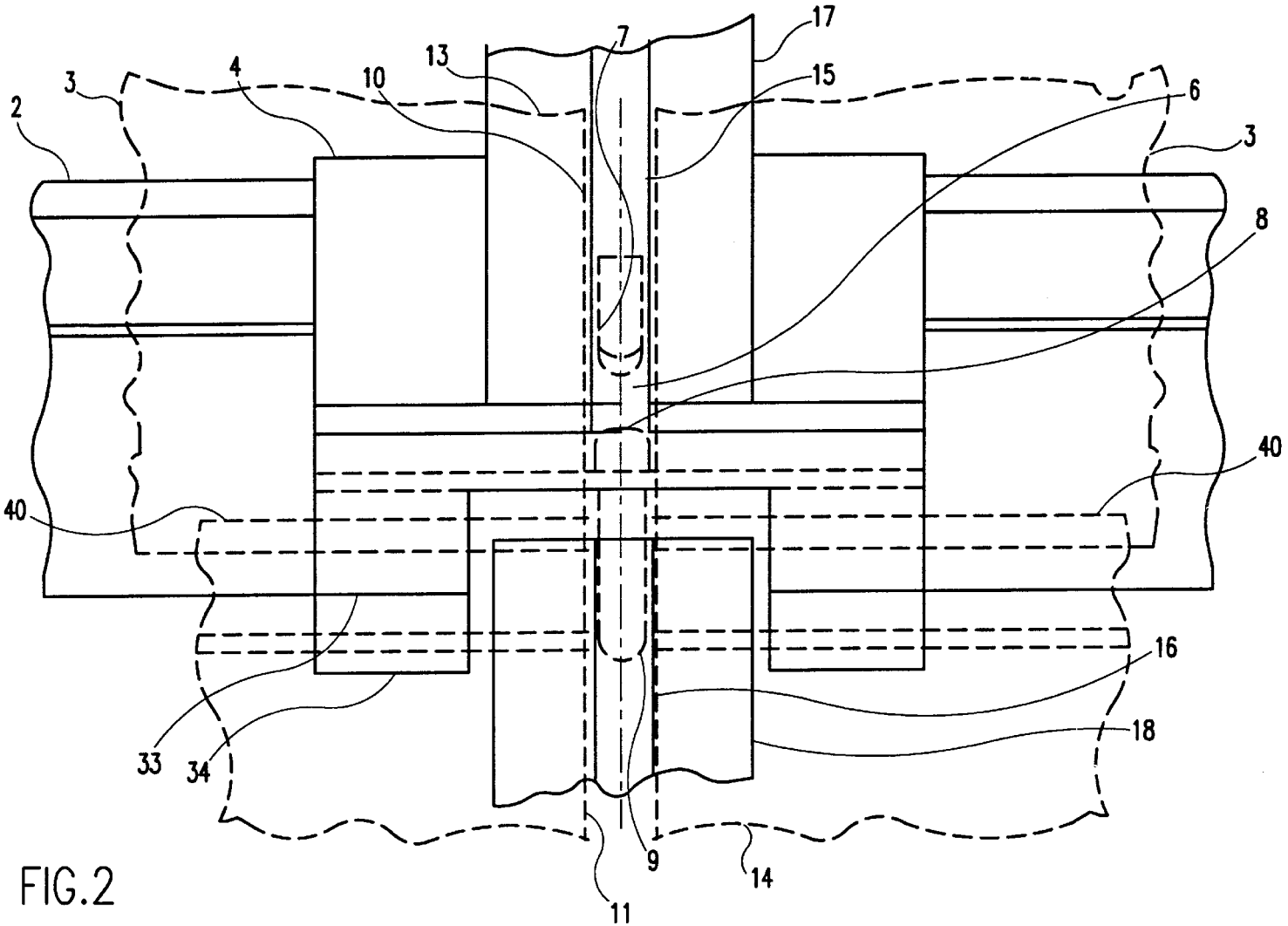
FIG. 2 shows the front view of the facade system.

FIG. 2 shows the horizontal section 2 on which the facade boards 3 are secured by means of the board holder 4. The tongue 7 of the holder 4 engages from behind into the knuckle 15 of the upper joint section 17, as a result of which the joint section 17 is centered relative to the holder 4. The knuckle 15 engages from behind into the joint 10 between the upper pair of boards 13 (shown in broken lines for reasons of clarity) and ensures the maintenance of the necessary joint spacing of the vertical joint 10. The knuckle 16 of the lower joint section 18 engages from behind into the joint 11 between the lower pair of boards 14 (drawn in broken lines for reasons of clarity) and ensures maintenance of the necessary gap spacing of the vertical gap 11. The tongue 9 engages from behind into the knuckle 16. The tongues 7 and 9 and 8 and 9, respectively, are arranged on the same vertical median axis and designed with axial symmetry. The two lower legs 33, 34 are notched at the center of the board holder 4, so that the head rabbets 40 of the pair of boards 14 engage not immediately adjacent to the joint 11 but at a distance therefrom. Instead of the tongue 7, the tongue 8 can also engage directly into the vertical joint 10 between the upper pair of boards 13.

Figure 3:
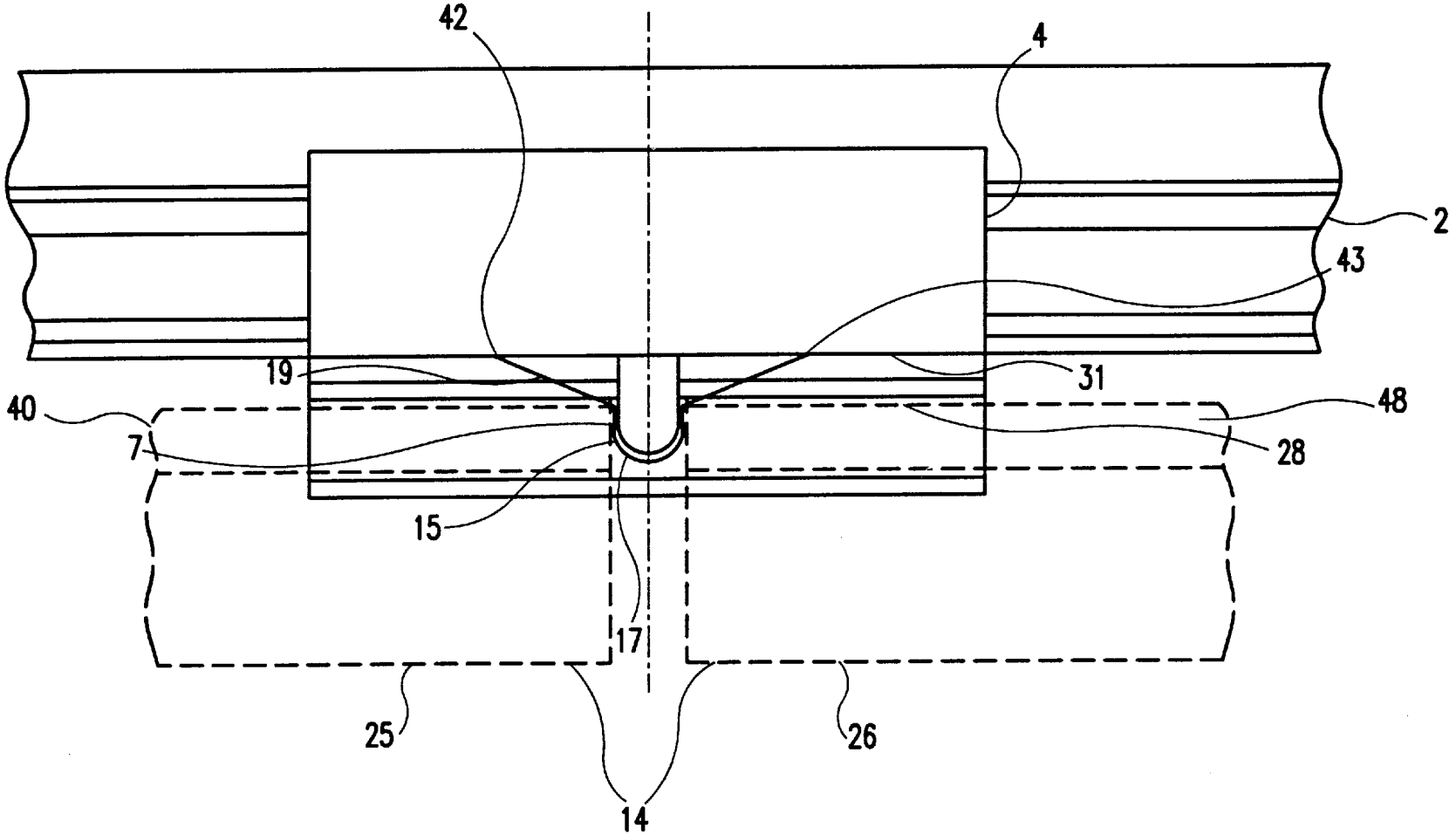
FIG. 3 shows the plan view of the facade system.

FIG. 3 shows the lower pair of boards 14, around whose head notches 40 the board holder 4 engages, these head rabbets 40 being fixed to the horizontal section 2. The tongue 7 engages from behind into the knuckle 15 of the upper joint section 17, which with its inward-projecting edges, not indicated in the Figure engages around the rear vertical edges also not indicated in the Figure of the facade boards 25, 26. The two resilient legs 19, 20 bear with their ends 42, 43 on the front surface 31 of the board holder 4.

What is claimed is:

1. An externally suspended facade system, comprising:

a subsystem, a section mountable on the subsystem, facade boards, board holders securing the facade boards on the section, and joint sections which are arranged relative to vertical joints between the facade boards, wherein the board holders are arranged centrally to the vertical joints and have at least one tongue for engaging in the vertical joints between one or more pairs of boards, said facade boards having head rabbets and lower rabbets.

2. The externally suspended facade system as claimed in claim 1, wherein, for a plurality of tongues, each having a median axis, the median axes of the tongues are arranged, viewed from a front of a facade, in a same vertical plane.

3. The externally suspended facade system as claimed in claim 1, wherein at least one of said at least one tongue is engageable in at least one knuckle of a vertical joint section.

4. The externally suspended facade system as claimed in claim 1, further comprising a joint section including a knuckle and two resilient legs having inwardly-projecting edges that engage around rear vertical edges of the facade boards and which have ends configured to bear on one selected from the group consisting of the front surface of the board holder, the front edge of the section, and combinations thereof.

5. The externally suspended facade system as claimed in claim 1, wherein the board holder has at least one lower leg which is notched at a center of the board holder.

6. The externally suspended facade system as claimed in claim 1, wherein the board holder has rear legs that terminate with a reinforcement directed toward the facade board.

7. An externally suspended facade system as claimed in claim 1, wherein the board holders comprise H-shaped parts with upper and lower legs for engaging the head rabbets and lower rabbets of the facade boards, each holder engaging two adjacent boards on both sides of the joint between adjacent facade boards.

8. An externally suspended facade system as claimed in claim 1, wherein the facade boards are held vertically.

9. The externally suspended facade system as claimed in claim 1, wherein the section is one selected from vertical, horizontal and combinations thereof.

* * * * *